United States Patent [19]

Baron et al.

[11] 4,382,465

[45] May 10, 1983

[54] CLEANING ARRANGEMENT FOR HEAT EXCHANGE TUBES

[75] Inventors: Walter J. Baron; Laird C. Cleaver, both of Milwaukee, Wis.

[73] Assignee: Water Services of America, Inc., Milwaukee, Wis.

[21] Appl. No.: 324,023

[22] Filed: Nov. 23, 1981

[51] Int. Cl.[3] ..... F28G 1/12

[52] U.S. Cl. ..... 165/95; 134/166 C; 134/169 C

[58] Field of Search ..... 165/95, 173, 174, 175; 134/166 C, 169 C

[56] References Cited

U.S. PATENT DOCUMENTS 3,319,710 5/1967 Heeren et al. .

3,973,592 8/1976 Cleaver et al. .

4,124,065 11/1978 Leitner et al. .

*Primary Examiner*—William R. Cline

*Assistant Examiner*—Susan Dotson

*Attorney, Agent, or Firm*—Andrus, Sceales, Starke & Sawall

[57] ABSTRACT

A plurality of elongated tube cleaning element capturing cages of different lengths are mounted within the heat exchanger chamber. The cages are so constructed and positioned so that fluid discharging outwardly from the cages flows laterally in a plurality of transverse planular layers. Fluid discharging laterally through the openings of the shorter cages impinges against closed wall portions of the longer cages, with the openings of the longer cages being disposed axially beyond the openings of the shorter cages. The longer and shorter cages may be arranged in substantially alternating relationship. In the event that some longer or shorter cages are disposed directly adjacent each other, openings of adjacent similar length cages are disposed in generally facing relationship with imperforate portions of the adjacent similar length cage.

6 Claims, 5 Drawing Figures

CLEANING ARRANGEMENT FOR HEAT EXCHANGE TUBES

U.S. PRIOR ART OF INTEREST

| U.S. Pat. No. | Inventor | Issue Date |
|---|---|---|
| 3,319,710 | Heeren et al. | May 16, 1967 |
| 3,973,592 | Cleaver et al. | Aug. 10, 1976 |
| 4,124,065 | Leitner et al. | Nov. 7, 1978 |

BACKGROUND AND SUMMARY OF THE INVENTION

This invention relates to a cleaning arrangement for heat exchanger tubes.

It is known from the above-identified patents to connect elongated cleaning element capturing cages to both ends of the heat exchanger tubes. The cages are adapted to contain shuttlable cleaning elements, such as brushes. Fluid flowing in one direction through the tubes keeps the cleaning elements captured within their respective cage chambers, while the fluid discharges outwardly through slot-like openings in the cage walls. Upon reversal of fluid flow, the cleaning elements are forced out of their cages and through the tubes to the cages at the opposite tube ends to thereby perform a tube cleaning action.

Heretofore, the cages have all been of approximately the same length with the fluid flow openings in the cage walls being transversely aligned in the same plane.

It has been observed that, especially in high fluid pressure applications, the cleaning elements sometimes tended to be pushed laterally outwardly and partially or completely through the cage openings. Upon fluid flow reversal, the cleaning elements could then no longer perform their cleaning function.

The present invention is directed to solving the problem of undesirable lateral displacement of the tube cleaning elements, while reducing the pressure drop of the laterally flowing fluid in the heat exchanger chamber containing the cage-cleaning element assemblies.

In accordance with an aspect of the invention, a plurality of elongated tube cleaning element capturing cages of different lengths are mounted within the heat exchanger chamber. The cages are so constructed and positioned so that fluid discharging outwardly from the cages flows laterally in a plurality of transverse planular layers.

In accordance with another aspect of the invention, fluid discharging laterally through the openings of the shorter cages impinges against closed wall portions of the longer cages, with the openings of the longer cages being disposed axially beyond the openings of the shorter cages.

In accordance with a further aspect of the invention, the longer and shorter cages may be arranged in substantially alternating relationship. In the event that some longer or shorter cages are disposed directly adjacent each other, openings of adjacent similar length cages are disposed in generally facing relationship with imperforate portions of the adjacent similar length cage.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
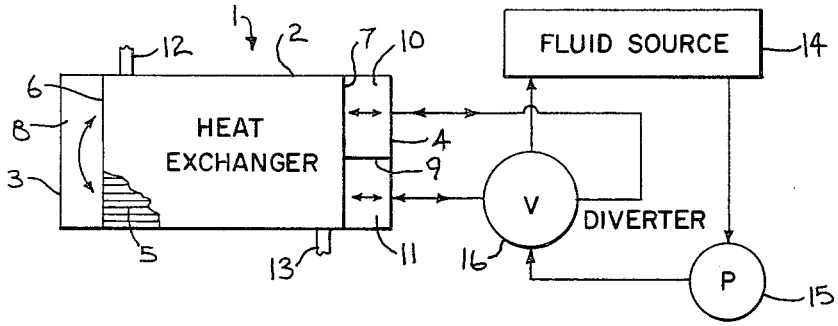
FIG. 1 is a schematic showing of a heat exchanger and fluid flow controls therefor.

The present invention is directed to tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Figure 2:
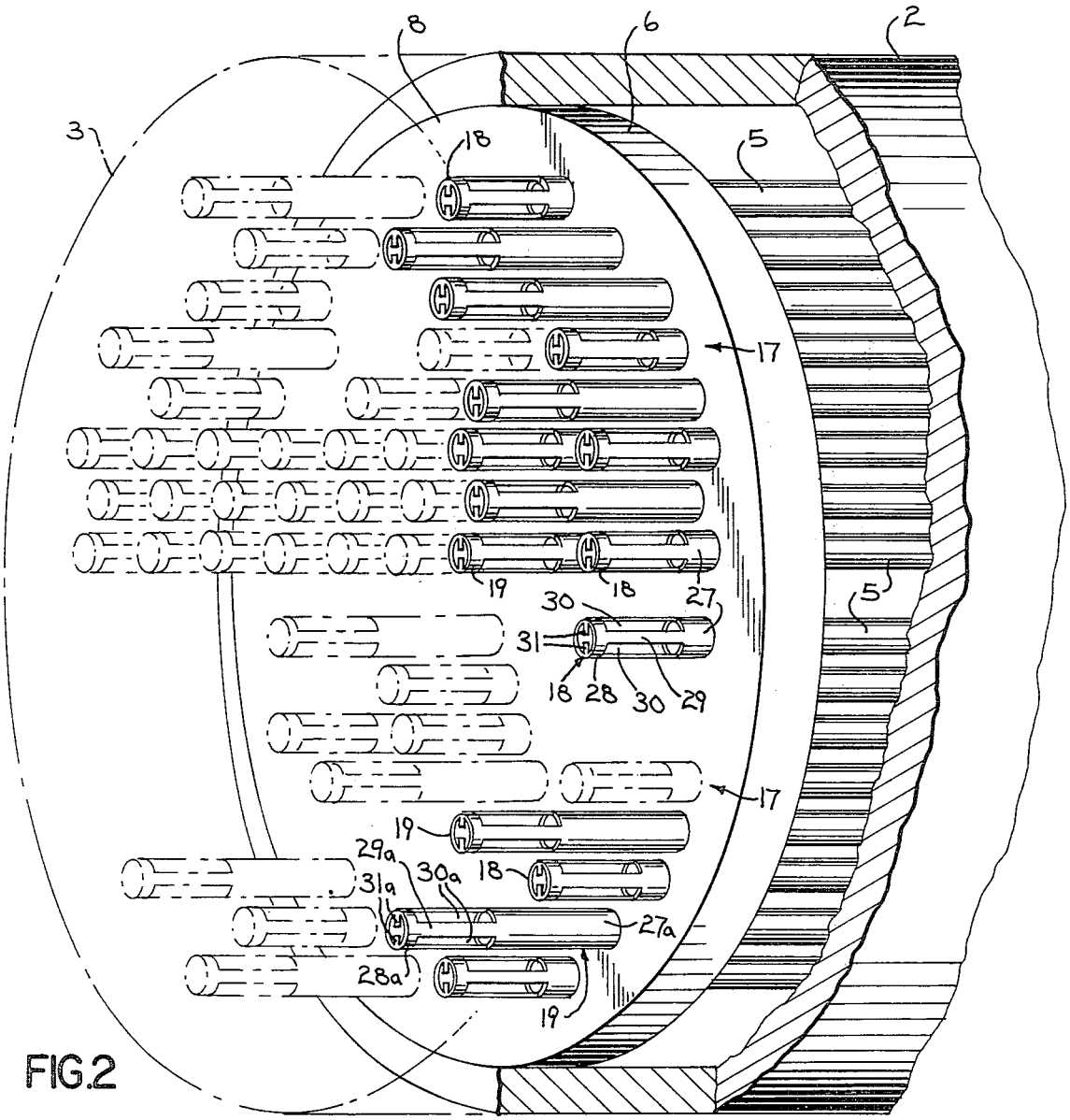
FIG. 2 is an enlarged perspective view within one end chamber of the heat exchanger and showing the cages of different lengths.
Figure 3:
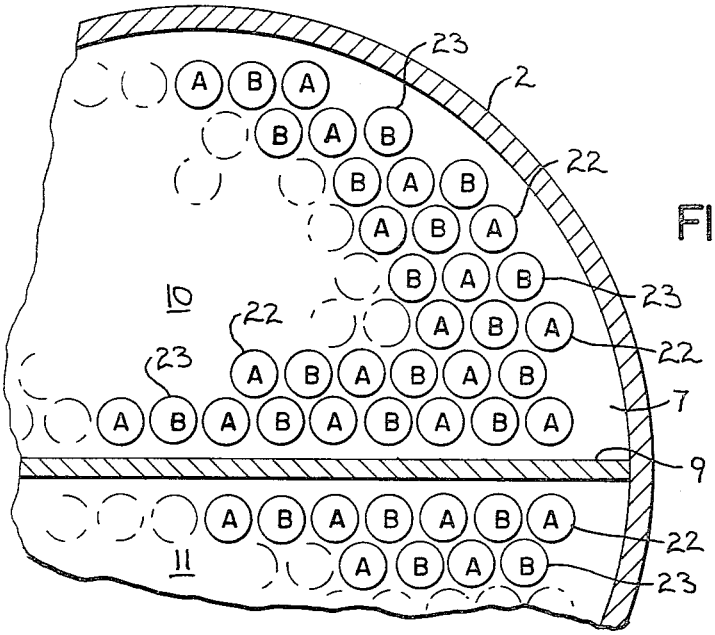
FIG. 3 is a schematic end view of the cages at the opposite end of the heat exchanger.
Figure 4:
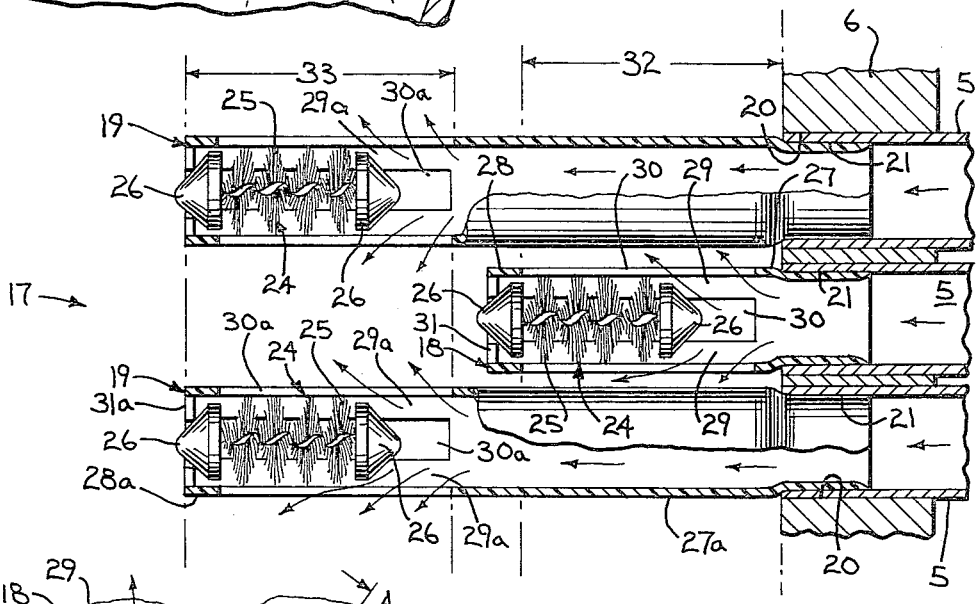
FIG. 4 is a longitudinal sectional showing, taken on line 4—4 of FIG. 5, of several of the cages with tube cleaning elements captured therein, and showing the fluid flow path.

Heat exchanger 1 is provided with tube cleaning means. For this purpose, and as shown in FIGS. 2 and 4, a plurality of cleaning assemblies 17 are disposed in chamber 8 and include longitudinally extending elongated basket-like cages 18 and 19 which are mounted to be in fluid communication with the interiors of tubes 5. The mounting may be accomplished in a variety of ways, but in the present embodiment, tubes 5 enter openings 20 in tube sheet 6, and the inner ends of cages 18 and 19 are reduced in diameter and press fit directly into the tube ends, as at 21. A similar plurality of cleaning assembly cages 22 and 23 are connected to the opposite ends of tubes 5, as shown in FIG. 3. Some of the cages in FIGS. 2 and 3 have been removed for purposes of drawing clarity, it being understood that the cages would all be normally closely spaced within the respective chambers.

Cages 18, 19, 22 and 23 are each adapted to capture and hold a shuttling tube cleaning element 24 which in this embodiment is shown as a brush 25 having conical end caps 26 thereon. See FIG. 4.

Cages 18 and 19 comprise a plurality of groups of different lengths. (The same is true of cages 22 and 23.) As best shown in FIGS. 2 and 4, cages 18 are shorter and comprise annular closed tubular inner and outer end portions 27 and 28 joined by an intermediate open portion comprising longitudinal ribs 29 and slot-like openings 30. The outer cage ends are formed with projections 31 which function as stops for tube cleaning elements 24.

Cages 19 also comprise annular closed tubular inner and outer end portions 27*a* and 28*a* joined by an intermediate open portion comprising longitudinal ribs 29*a* and slot-like openings 30*a*; together with projections 31*a*. In this instance, however, cage 19 is longer than cage 18. For this purpose inner end portions 27*a* extend longitudinally outwardly beyond the outer terminus of openings 30 of cages 18, and in the present embodiment extend beyond the ends of cages 18. Inner end portions 27*a* of long cages 19 thus form closed walls adapted to confront the open portion of an adjacent short cage 18. The open intermediate slotted portions of long cages 19 are disposed longitudinally outwardly of the open slotted portions of short cages 18.

The result is that, as fluid flows out of tubes 5, as in FIG. 4, and through cages 18 and 19, the fluid will be discharged laterally in a pair of transverse planular generally discrete fluid flow layers 32 and 33 respectively. The amount of fluid flowing in each layer will be less than the amount of fluid flowing transversely in prior known devices with cages all of the same length. Lateral fluid flow across the face of the cage support, in this case tube sheet 6, via layer 32 will be minimized, as will the pressure drop. This will help reduce the chance of a cleaning element 24 being pushed outwardly through openings 30. The lateral flow in layer 33, which is disposed longitudinally outwardly from layer 32, will also be minimized.

Figure 5:
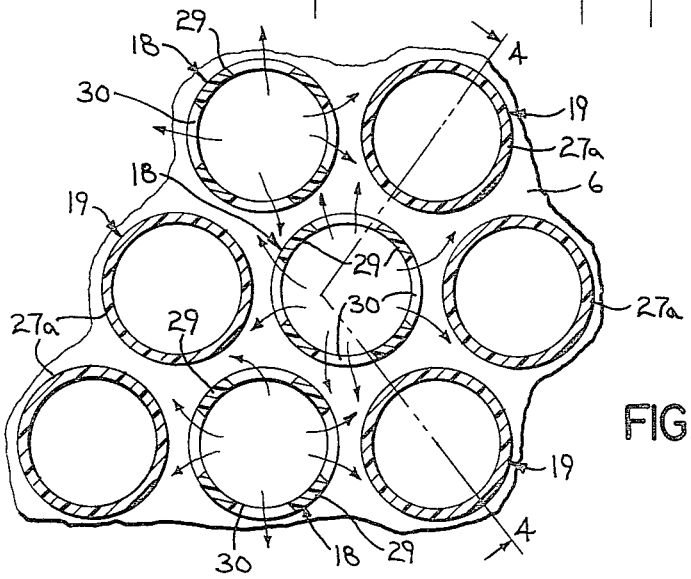
FIG. 5 is a schematic transverse section through the inner end portions of a number of adjacent cages.

As can be observed in FIGS. 4 and 5, fluid discharging through openings 30 of short cages 18 impinges on the closed wall portions 27*a* of adjacent long cages 19. By the same token, fluid discharging through openings 30*a* will not engage cages 18. Layer 32 forms a separating boundary.

It is believed preferable that the long and short cages be approximately equal in number and arranged in alternating relationship as much as possible. This is illustrated in FIG. 3 where short cages 22 are marked as A and long cages 23 are marked as B. As shown, cages 22 and 23 are disposed in horizontal rows with the cage lengths alternating. However, because the rows are staggered, cages of the same length will occasionally be disposed adjacent each other. This is also illustrated in FIG. 5 relative to cages 18 and 19. In this instance, cages 18 are mounted so that openings 30 are out of registry and generally face the imperforate ribs 29 of an adjacent cage 18 so that fluid will not tend to flow out of one cage into another.

The concepts of the invention are believed to provide an important advance in the art of cleaning of heat exchanger tubing.

Various modes of carrying out the invention are contemplated as being within the scope of the following claims particularly pointing out and distinctly claiming the subject matter which is regarded as the invention.

We claim:

1. In a heat exchanger having a housing containing a plurality of fluid flow tubes arranged with exposed open ends adapted to communicate with a housing chamber, the combination comprising:

(a) a plurality of groups of closely adjacent longitudinally extending cages disposed in said chamber for capturing and holding shuttle type tube cleaning elements therein, (b) mounting means for placing the inner ends of said cages in fluid communication with the interiors of said tubes, (c) said cages having openings in their walls for allowing lateral outward discharge of fluid therethrough, (d) one group of cages having their said openings disposed longitudinally outwardly of the openings in the other group of cages so that lateral outward discharge of water through the cage openings forms a plurality of generally discrete transverse planular fluid flow layers.

2. The combination of claim 1 in which said one group of cages have closed wall portions disposed in facing relationship to the openings in the said other group of cages so that fluid discharging laterally from said last-named openings impinges on said closed wall portions.

3. The combination of claim 1 or 2 in which the cages of said one group of cages are arranged in substantially alternating relationship with the cages of said other group of cages.

4. The combination of claim 1 or 2 in which:

(a) at least some of the cages in a group of cages are disposed adjacent other cages of the same group, (b) the openings in adjacent last-named cages being out of registry with each other.

5. The combination of claim 1 or 2 in which said one group of cages is longer than said other group of cages.

6. In a heat exchanger having a housing containing a plurality of fluid flow tubes arranged with exposed open ends adapted to communicate with a housing chamber, the combination comprising:

(a) a plurality of groups of closely adjacent longitudinally extending cages disposed in said chamber for capturing and holding shuttle type tube cleaning elements therein, (b) mounting means for placing the inner ends of said cages in fluid communication with the interiors of said tubes, (c) said cages having openings in their walls for allowing lateral outward discharge of fluid therethrough, (d) one group of cages having their said openings disposed longitudinally outwardly of the openings in the other group of cages so that lateral outward discharge of water through the cage openings forms a plurality of generally discrete transverse planular fluid flow layers, (e) said one group of cages being longer than said other group of cages and having closed wall portions disposed in facing relationship to the openings in the said other group of cages so that fluid discharged laterally from said last-named openings impinges on said closed wall portions, (f) the cages of said one group of cages being arranged in substantially alternating relationship with the cages of said other group of cages, (g) at least some of the cages in a group of cages being disposed adjacent other cages of the same group, (h) the openings in adjacent last-named cages being out of registry with each other.

* * * * *